United States Patent [19]

Walter

[11] 4,114,194

[45] Sep. 12, 1978

[54] ULTRASONIC CLEANER

[75] Inventor: Henry J. Walter, Wilton, Conn.

[73] Assignee: Clairol, Inc., New York, N.Y.

[21] Appl. No.: 824,239

[22] Filed: Aug. 12, 1977

Related U.S. Application Data

[63] Continuation of Ser. No. 679,409, Apr. 22, 1976, abandoned.

[51] Int. Cl.[2] ..... B01F 11/02

[52] U.S. Cl. ..... 366/111; 310/318

[58] Field of Search ..... 259/72, DIG. 44, 1 R; 134/184, 177, 57 DL; 200/61.62, 61.71, 61.7; 220/1 E, 200, 356; 335/205; 366/111, 112, 116; 310/801; 318/114

[56] References Cited

U.S. PATENT DOCUMENTS

| | | | |
|---|---|---|---|
| 3,129,366 | 4/1964 | Fry | 318/114 |
| 3,161,742 | 12/1964 | Bagno | 335/208 |
| 3,254,284 | 5/1966 | Tomes | 318/118 |
| 3,266,653 | 8/1966 | Gauthier | 220/1 E |
| 3,426,166 | 2/1969 | Canceill | 200/61.62 |
| 3,469,211 | 9/1969 | Shoh et al. | 331/116 M |
| 3,480,258 | 11/1969 | Massa | 366/111 |
| 3,487,237 | 12/1969 | Krenke | 310/8.1 |
| 3,575,383 | 4/1971 | Coleman | 134/184 |
| 3,581,125 | 5/1971 | Arndt et al. | 310/8.1 |
| 3,584,244 | 6/1971 | Vest | 310/8.1 |
| 3,590,321 | 6/1971 | Scheidweller | 200/61.62 X |
| 3,595,532 | 7/1971 | Doyle | 366/111 |
| 3,596,206 | 7/1971 | Loria | 331/116 R |
| 3,596,883 | 8/1971 | Brech | 366/115 |
| 3,651,352 | 3/1972 | Puskas | 310/8.1 |
| 3,678,331 | 4/1970 | Racz | 220/356 |
| 3,694,713 | 9/1972 | Durem et al. | 310/8.1 X |
| 3,709,732 | 1/1973 | Thomen | 134/57 D |
| 3,743,868 | 7/1973 | Kawada | 310/8.1 |
| 3,771,154 | 11/1973 | Takei | 200/61.62 X |
| 3,778,648 | 12/1973 | Kawada | 310/8.1 |
| 3,806,852 | 4/1974 | Suska | 200/61.7 |
| 3,807,704 | 4/1974 | Janzen et al. | 366/111 |
| 3,809,977 | 5/1974 | Balamuth | 318/116 |
| 3,866,068 | 2/1975 | Krenicki et al. | 310/8.1 |

OTHER PUBLICATIONS

Charles W. Behens, *Portable Cleaner Sounds Out Toughest Dirt.* In Appliance Manufacturer, pp. 64–66, Apr. 1969.

Texas Instruments, Inc. *Transistor Circuit Design* McGraw-Hill Book Co. pp. 180–183.

F. E. Terman, *Radio Engineers Handbook* McGraw-Hill Book Co. 1943 pp. 480–483.

*Primary Examiner*—Billy S. Taylor

*Attorney, Agent, or Firm*—David J. Mugford; George A. Mentis; Samuel J. Duboff

[57] ABSTRACT

An ultrasonic cleaner for domestic use includes a high-power circuit for driving an ultrasonic transducer and a low-power safety switch which enables the high-power circuit only when a cover is in place over the cleaner. The safety switch is a magnetically actuated reed switch, the contacts of which are closed by a magnet on the cover.

8 Claims, 6 Drawing Figures

ULTRASONIC CLEANER

This is a continuation of application Ser. No. 679,409, filed Apr. 22, 1976, and now abandoned.

BACKGROUND OF THE INVENTION

1. Field of the Invention

The instant invention relates to ultrasonic cleaners and, more precisely, the instant invention relates to ultrasonic cleaners of the type, in which a liquid is ultrasonically agitated to clean articles immersed in the liquid.

2. Technical Considerations and Prior Art

The ability of a liquid when ultrasonically agitated to penetrate small spaces and, by cavitation, to remove foreign matter from solid objects has led to the wide use of ultrasonic cleaners in laboratories and industry. Frequently, it is not possible to clean or remove foreign matter by any other process.

The effects of ultrasonic energy on living organisms are not fully understood, Accordingly, it is important to avoid exposing users of ultrasonic cleaners and the like to direct contact with ultrasonic energy. When ultrasonic energy is used in physiotherapy, the treatment can only be performed under medical supervision. Consequently, it is important that any ultrasonic product, such as an ultrasonic cleaner, which may be for home use, have built-in safety features which will not permit the user to come into direct contact with an ultrasonically excited medium, such as the cleaning liquid which is used in ultrasonic cleaners.

Many domestic cleaning chores, done commercially by ultrasonics, such as the removal of plaque and calculus from dentures, removal of oxidation from silverware and jewelry, and the removal of rust from hand tools and small parts, could be done domestically. This, of course, has been recognized, and consumer ultrasonic cleaners have appeared on the market from time to time. However, these cleaners have not been successful, because in order to prevent possible injury to the user, the power output has to be kept so low that effective cleaning is not accomplished.

In an ultrasonic cleaner, suitable for domestic use, it is necessary that the cleaner be easy to operate and be pleasing in appearance, in addition to be safe. In this regard, the cleaner should be easy to fill with a cleaning liquid, such as water, and should fit in any decor.

Preferably, the domestic cleaner should be able to utilize existing ultrasonic driving circuits currently used in commercial cleaners, and yet have the aforementioned safety, ease of operation, and appearance.

OBJECTS OF THE INVENTION

In view of the aforementioned considerations and other considerations, it is an object of the instant invention to provide a new and improved ultrasonic cleaner, or the like, which is safe for domestic use.

It is another object of the instant invention to provide a new and improved ultrasonic cleaner, which is both easy and convenient to operate, and is pleasing in appearance.

It is still an additional object of the instant invention to provide a new and improved ultrasonic cleaner, which is as powerful as commercial cleaners, but which has safety features, which permit the cleaner to be used domestically.

It is still another object of the instant invention to provide a new and improved ultrasonic cleaner, which is easy to fill with the correct amount of cleaning liquid.

SUMMARY OF THE INVENTION

The present invention contemplates an ultrasonic cleaner, which safeguards the user from contact with ultrasonic energy used by the cleaner. The ultrasonic cleaner includes a tank portion having a receptacle or bowl therein, which holds cleaning fluid that is ultrasonically excited by a transducer. A cover fits over the tank portion and, in effect, encloses the receptacle when in place. In order to preclude operation of the ultrasonic cleaner when the cover is not in place, the cleaner includes a low-power switch, which has contacts which are closed only when the cover is in place. The cover includes an actuator thereon, which closes the contacts, upon being mounted over the tank portion. When the contacts are closed, it is possible to energize a relatively high-power ultrasonic driving circuit, which drives the transducer to agitate the cleaing liquid.

DETAILED DESCRIPTION

Figure 1:
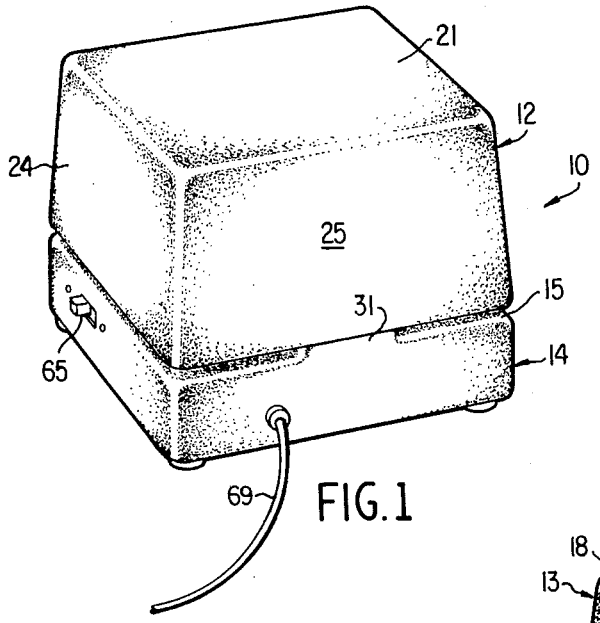
FIG. 1 is a perspective view of an ultrasonic cleaning apparatus, in accordance with the instant invention, showing a cover of the cleaner in place over a tank portion of the cleaner, which permits operation of the cleaner.

Referring now to FIG. 1, an ultrasonic cleaner, designated generally by the numeral 10, has a cover, designated generally by the numeral 12, which fits over the cleaner. In the illustrated embodiment, the ultrasonic cleaner 10 has a generally rectangular configuration. However, any configuration, which is pleasing in appearance, would be suitable.

Figure 2:
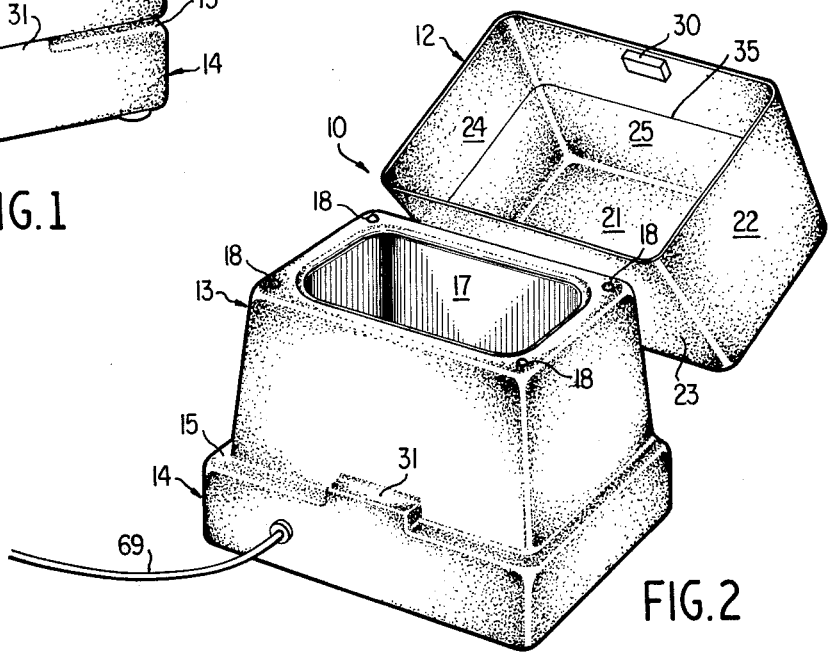
FIG. 2 is a perspective view of an ultrasonic cleaner, in accordance with the principles of the instant invention, wherein the cover of the cleaner is removed from the tank portion not permitting operation of the cleaner.

Referring now to FIG. 2, the cover 12 is shown, removed from the ultrasonic cleaner 10. As is seen in FIG. 2, the ultrasonic cleaner consist of an upper housing or tank portion, designated generally by the numeral 13, over which the cover fits and a lower housing portion, designated generally by the numeral 14, which contains circuitry for operating and driving the cleaner. The housing 14 has a slightly larger cross-sectional area than the tank portion 13 and, consequently, projects slightly beyond the tank portion 13 to form a shoulder 15. As is seen in FIG. 1, when the cover 12 is placed over the tank portion 13, the outside surface of the cover is generally aligned with the outside surface of the housing 14.

Figure 4:
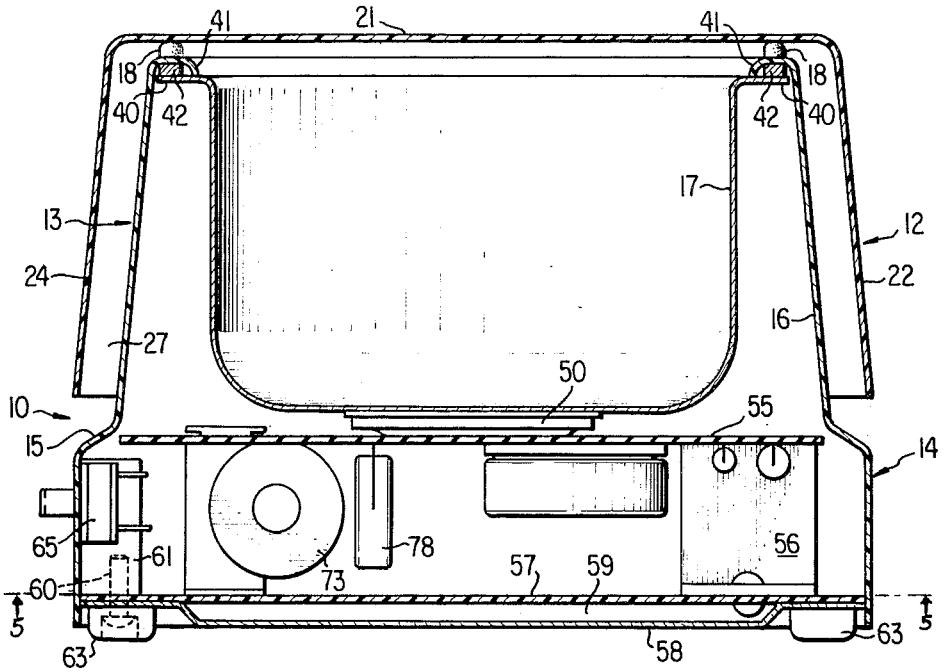
FIG. 4 is a side view in section, showing the internal configuration of the ultrasonic cleaner, in accordance with the instant invention.

As can be seen in FIG. 4, the tank portion 13 includes an outer case portion 16, and a stainless steel receptacle 17, which is retained within the case portion 16. The receptacle 17 is held in place by screws 18, which have healed portions that project above the top of the tank portion 13. When the cover 12 is in place, as shown in FIG. 1, the cover will rest on the heads of the screws 18, instead of directly on the tank portion 13. This permits a gap between the tank portion 13 and the cover 12, so that moisture will not cause the cover 12 to adhere to the tank portion 13, and prevent easy disengagement of the cover from the tank portion. The depth of the cover 12 is slightly less than the height of the tank portion or upper housing 13.

As seen in FIGS. 1 and 2, the cover includes a top 21 and side flanges 22, 23, 24 and 25. The side flanges fit around the tank portion 13, so that the tank portion 13, in effect, nests within the cover 12. Preferably, the side flanges 22–25 are trapezoidal in shape, and flare slightly away from the top 21. Since the tank portion 13 has generally vertical sides, there will be a gap 27 (see FIG. 3 and 4) between the flanges 22–25 and the tank portion, which widens the direction of the open end of the cover 12.

Figure 3:
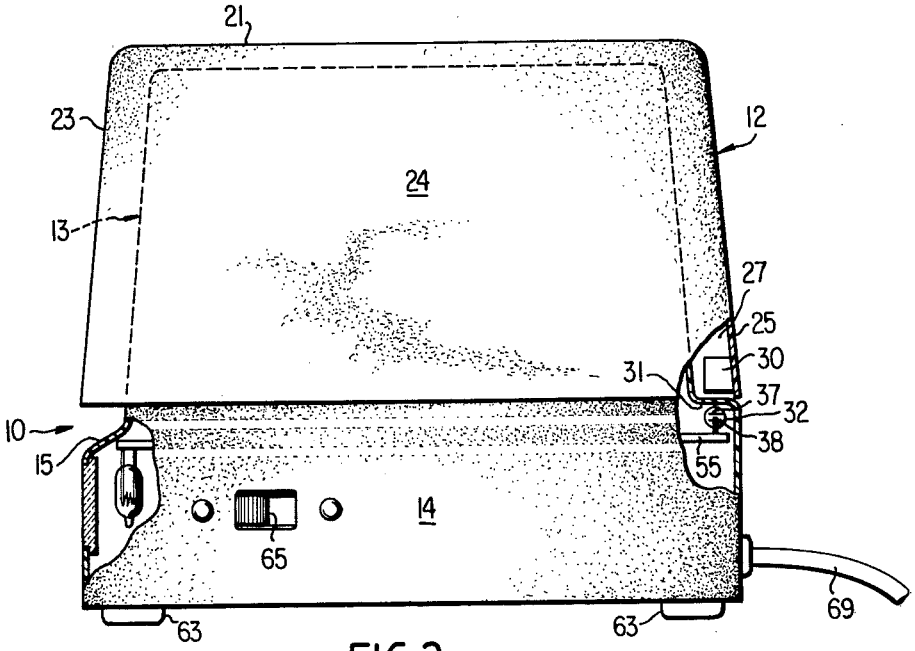
FIG. 3 is a side view of the ultrasonic cleaner, in accordance with the instant invention, partially cut away to show a safety reed switch located in the tank portion, and a magnet for operating the reed switch located in the cover.

As is seen in FIG. 3, a magnet 30 is positioned on the flange 25 at the open end of the cover 12. The magnet 30 projects into the gap 27 (FIG. 3). A raised portion 31 projects upwardly from the shoulder 15 of the housing portion 14, and includes a magnetically operable reed switch 32. When the magnet comes into proximity with the magnet reed switch 32, the switch will close and permit operation of the ultrasonic cleaner 10. It is only possible to close the switch by nesting the cover 12 over the tank portion 13 to effect proximity of the magnet 30 and switch 32. Since it is not necessary to have actual contact between the magnet and switch 32, the switch may be completely enclosed. This has two advantages in that water cannot flow from the cover over the switch 32 and in that the switch is completely enclosed to prevent shocks to the user.

As is seen in FIG. 2, the cover 12 has a line 35, scored or otherwise, formed around the inner periphery of the cover. The line 35 defines volume of liquid, which should be placed in the bowl or receptacle 17. Consequently, one may use the cover to fill the receptacle 13, and the line 35 identifies the level to which the cover should be filled. Accordingly, the ultrasonic cleaner 10 may be located in any convenient place, and need not be placed under a spigot for filling. This is important, because if the container were filled from a spigot, water might possibly get into the driving circuit, which could possibly ruin the circuit or increase the danger of an electrical shock to the user.

Referring now to FIG. 3, portions of the ultrasonic cleaner 10 and the cover 12 are shown broken away. The reed switch 32 has a pair of contacts 37 and 38 disposed therein, which are spaced apart when the cover 12 is removed, and which are in contact when the cover 12 is in place. The magnet 30, attached to the cover 12, closes the contacts 37 and 38, when the cover 12 is in place, while when the cover is not is place, the contacts remain open. The structure of the switch is well known in the switching art and is, normally referred to as a magnetic reed switch. Generally, the switch 32 consists of a sealed glass tube, which is either evacuated or filled with an inert gas. At least one of the contacts 37 or 38 is of ferrous material, so as to be deflected by the magnet 30. Generally, the contacts 37 and 38 are simply cantilevered within the glass envelope.

Referring now to FIG. 4, the general internal structure of the ultrasonic cleaner 10 is shown. The receptacle or bowl 17 has a lip 40, which extends around the upper end thereof. The lip 40 receives the screws 18 therein to retain the bowl within the case 16 to form the tank portion 13. The case 16 has a rim 41, which projects downwardly into the tank portion, and a gasket 42 is positoned behind the rim, and engaged by the lip 40 of the receptacle 17. A water-tight seal is thereby achieved between the receptacle 17 and the casing 16.

An ultrasonic transducer 50 which is a piezoelectric crystal is secured to the outside of the bottom of the receptacle 17 by an epoxy cement. The transducer 50 ultrasonically excites the entire receptacle 17, and this excitation is transferred to the cleaning liquid within the receptacle. The cleaning liquid, in turn, transfers the ultrasonic excitation to particles on objects immersed in the liquid to dislodge the particles from the objects, thereby cleaning the objects.

Figure 6:
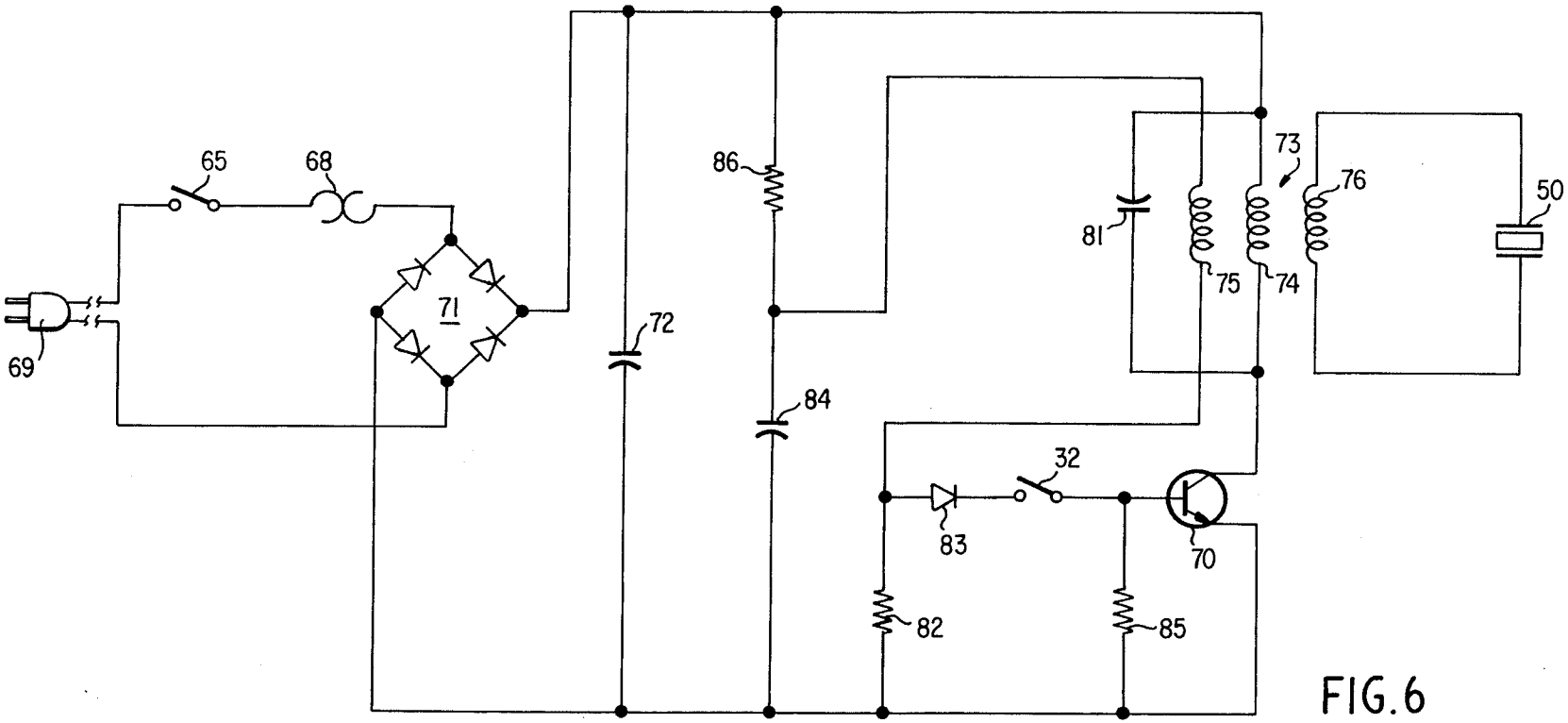
FIG. 6 is a circuit diagram of a driving circuit, which is utilized to power the ultrasonic cleaner of the instant invention, and which has the safety reed switch, associated therewith.

The case 16 is joined to the housing 14 by the shoulder 15 to form a continuous unit. The housing 14 contains a substrate 55, upon which the circuitry of FIG. 6 is mounted. The substrate 55 has a U-shaped bracket 56, which extends downwardly therefrom, and is bolted to a backing plate 57. Both the U-shaped bracket 56 and the backing plate 57 are made of metal, and serve to dissipate heat from a power transistor, which is used to drive the crystal or transducer 50. A base plate or shield 58 is fitted over the backing plate 57, and is bent so that there is a space 50 therebetween. The backing plate 57 and shield 58 are secured to the housing by screws 60, which are threaded into spacers 61, positioned in the four corners of the housing portion 14. Preferably, the screws 60 hold rubber pads or feet 63 in place, and the cleaner 10 rests on the feet 63, in spaced relation to the surface upon which it is placed.

A manually operable switch 65 projects through one side of the housing, while the switch 32 projects from the substrate 55 into the raised portion 31, at an adjacent side of the housing.

Figure 5:
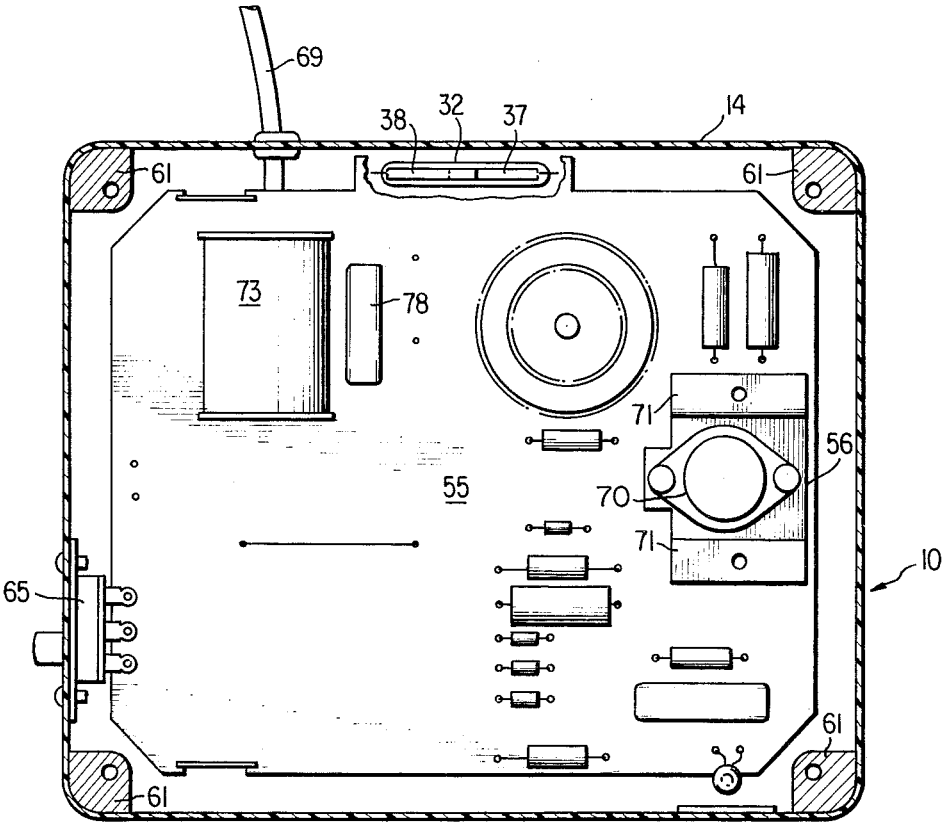
FIG. 5 is a section, through the ultrasonic cleaner of the instant invention, taken along lines 5—5 of FIG. 4 showing, among other things, the mechanical positioning of electrical components.

Referring now to FIG. 5, a bottom view of the ultrasonic cleaner 10 is shown with the metal backing plate 57 (see FIG. 4) and shield 58 (see FIG. 4) removed. The substrate 55 is also cut away to show the switch 32 which projects above the substrate into the raised portion 31. The various elements of the circuitry shown in FIG. 6 are mounted on the bottom side of the substrate 55, so as to face toward the metal backing plate 57, while the circuit paths connecting the various elements, are mounted on the top side of the substrate 55, so as to face the receptacle 17. The U-shaped bracket 56, which retains the substrate 55 in place, contains a power transistor 70 between the legs 71 thereof. The brackets 56 serve as a heat sink which transfer heat away from the power transistor 70 and the substrate 55 into the surrounding atmosphere. Since the metal backing plate 57 is secured to the bracket, the plate 57 also helps to dissipate heat.

Referring now to FIG. 6, there is shown a circuit for driving the crystal oscillator or transducer 50. The transducer driving circuit is powered by house current, which is fed in over a line 69, and is converted from 60 hertz AC to DC by a full wave bridge rectifier 71. The rectifier 71 does not smooth out the 120 hertz ripple occurring in the line, and the DC voltage from the oscillator drops almost to zero 120 times a second. This fluctuation causes the output amplitude of the crystal 50 to pulsate at a rate of 120 hertz. The output of the crystal may, therefore, decrease to a relatively low value or may turn off completely when the voltage is too low to sustain oscillations. The oscillator or transducer driving circuit should have a power input in the range of 25–100 watts and the transducer output should be in the range of 18–70 watts. Preferably the transducer 50 has a power output of 3 watts.

A conventional feedback power oscillator circuit is formed by the power transistor 70 and a three-winding transformer 73. The primary winding 74 of the transformer 73 is connected to the collector of the power transistor, and receives power from it at a frequency of 40,000 hertz. The secondary winding 75 of the transformer 73 supplies drive power to the base of the power transistor 70. The third winding 76 of the transformer 73 supplies output power to the crystal 50. The operation of the LC circuit is similar to the tuned plate oscillator, described in the book Transistor Circuit Design, Texas Instruments, Inc., McGraw-Hill Book Company, 1963, Page 181, FIGS. 12.2(*a*).

The power transistor 70 operates with load which consists of transformer 73 and capacitor 81 which form a high "Q" tuned circuit. This tuned circuit receives energy from the transistor 70 when the voltage across the transistor is low and delivers power to the crystal continuously in sine wave form. The tuned circuit acts as a filter to prevent transient voltage spikes at the collector of the transistor 70. Base bias for transistor 70 is provided by bias resistor 86. Capacitor 84 serves as a low impedance current source during that part of the cycle when transistor 70 is turned on. Resistor 86, Capacitor 84, and the number of turns on the secondary winding 75 of transformer 73 are so chosen that current will flow in transistor 70 for considerably less than half of each cycle, resulting in class "C" operation.

The power transistor 70 also has a maximum negative grid voltage limitation, and the turns ratio of the transformer 73 is selected to provide adequate drive for the necessary power output. Since the power transistor 70 presents a low impedance for positive signals, when in the "on" condition, the negative swing would exceed the rating, except for blocking diode 83. Whenever the bias voltage goes below the emitter voltage, the diode 83 becomes non-conducting thereby effectively limiting base swing and allowing current through bias resistor 86 to charge capacitor 84. When the polarity of the output of transformer 73 reverses, and the base of the power transistor 70 goes 0.6 volts above the emitter, the base emitter diode of the power transistor is forward biased and turns on, thereby limiting the positive voltage swing and discharging the capacitor 84.

The magnetic reed switch 32, positioned in the housing 14 and operated by the magnet 30, attached to the cover 12, is connected between the resistor 85 and the second winding 75 of the transformer 73. When the contacts 37 and 38 of the switch are opened, by removing the magnet 30, oscillations stop at once because the drive signal to the transistor 70 is removed. When the switch 32 is closed, oscillations restart. The switch 32 is a low-power switch, which carries only about 50 milliamperes of current, at less than 50 volts and, consequently, may be small in size and can be activated by a very light and small permanent magnet, such as the magnet 30 attached to the cover 12.

Resistor 82 serves to limit the charge on capacitor 84 to less than 50 volts when switch 32 is open, thus preventing the flow of excessive current when switch 32 closes. Resistor 85 prevents thermal runaway of transistor 70 when switch 32 is open, by providing a conductive path between the base and the emitter of transistor 70.

With high-power ultrasonic equipment, there is a danger of overheating, if the unit is operated without liquid in the tank, because most of the outputs would be converted to heat in the piezoelectric crystal or transducer 50. Since the crystal or transducer 50 will lose its piezoelectric properties permanently, if it is heated over curie temperture, there must be means provided to turn the oscillator off, when the crystal temperature exceeds a predetermined value. This is done by thermostat 68, which is located near the crystal 50 and senses its temperature. As the temperature of the crystal 50 reaches the thermostat operating temperature, the thermostat opens and removes power from the oscillator, thereby stopping its action. In this way, the crystal 50 is prevented from overheating.

Utilization of the reed switch 32 in series with the base of transistor 70 allows the ultrasonic cleaner 10 to both safely and conveniently utilize the high-power circuit of FIG. 6 to drive the piezoelectric crystal 50, and thereby renders it possible to have a high-power ultrasonic cleaner suitable for home use.

Preferably, the casing 16 and housing 14 are made of plastic and form an integral unit. The cover 12 is also preferably an integral plastic unit.

I claim:

1. An ultrasonic cleaner for cleaning relatively small articles comprising:

a metallic receptacle for containing a liquid in which articles to be cleaned are immersed, said receptable having an open top periphery;

ultrasonic transducer means secured to the bottom of the receptacle and a power circuit including a relatively high power transducer driving circuit for the ultrasonic transducer means;

a lower housing portion containing the power circuit and ultrasonic transducer means;

an upper housing portion having a cross-sectional area less than that of the lower housing portion and joined to the lower housing portion by a peripherally extending shoulder, said upper housing portion extending above the lower housing portion to a height greater than the height of the receptacle, said upper housing portion containing the receptable therein and having a top rim which fits over the top periphery of the receptacle to define a top opening into the receptacle;

a cover having an open end and a cross-sectional area greater than the upper housing portion and having a depth slightly less than the height of the upper housing portion, wherein the cover slides over the upper housing portion and substantially surrounds the upper housing portion when in place;

means defining spaced projections disposed around said rim of said upper housing portion, wherein said means holds said cover in spaced relation with respect to said rim when the cover is in place over the upper housing portion;

a magnet secured to the cover adjacent the open end thereof; and a low-power magnetic reed switch which is positioned adjacent said shoulder so that when said cover is in place over the upper housing portion, the magnet will close the magnetic reed switch and thereby allow said power circuit to energize said ultrasonic transducer means to operate the ultrasonic cleaner.

2. The ultrasonic cleaner of claims 1 wherein the transducer driving circuit has a power input in the range of 25 to 100 watts and wherein the power circuit includes means limiting the load to the reed switch to about 50 milliamperes, at less than 50 volts.

3. The ultrasonic cleaner of claim 1 wherein the cover has a line formed around the inside of the enclosure which identifies the level to which the liquid should fill the cover in order to provide the proper volume of liquid for the receptacle portion.

4. The ultrasonic cleaner of claim 1 wherein the switch is mounted in a raised portion on said shoulder and wherein said raised portion is integrally formed with the casing and housing.

5. The ultrasonic cleaner of claim 1 wherein the cross-section of the enclosure formed by the cover expands toward the open end thereof forming a gap between the enclosure formed by the cover and the upper housing portion and wherein the magnet projects into the gap.

6. The ultrasonic cleaner of claim 1 wherein the spaced projections on said rim are the heads of screws which project through the rim and through a lip projecting from the periphery of the receptacle to suspend the receptacle within the upper housing.

7. The ultrasonic cleaner of claim 1 wherein the upper housing portion, shoulder and lower housing portions are a unitary structure made of plastic and wherein the cover is made of plastic.

8. The ultrasonic cleaner of claim 1 wherein the cleaner is rectangular in cross-section.

* * * * *